US010667658B2

(12) United States Patent
Hunzeker

(10) Patent No.: US 10,667,658 B2
(45) Date of Patent: Jun. 2, 2020

(54) PUMP FOR REMOVING FLUIDS FROM FLOOR COVERINGS AND RELATED METHODS

(71) Applicant: Daniel Hunzeker, Idaho Falls, ID (US)

(72) Inventor: Daniel Hunzeker, Idaho Falls, ID (US)

( * ) Notice: Subject to any disclaimer, the term of this patent is extended or adjusted under 35 U.S.C. 154(b) by 497 days.

(21) Appl. No.: 15/481,851

(22) Filed: Apr. 7, 2017

(65) Prior Publication Data

US 2017/0303753 A1 Oct. 26, 2017

Related U.S. Application Data

(60) Provisional application No. 62/326,752, filed on Apr. 23, 2016.

(51) Int. Cl.

| | |
|---|---|
| ***A47L 5/04*** | (2006.01) |
| ***A47L 7/00*** | (2006.01) |
| ***F04B 23/02*** | (2006.01) |
| ***F04B 19/22*** | (2006.01) |
| ***F04B 53/10*** | (2006.01) |
| ***B08B 5/04*** | (2006.01) |
| ***F04B 53/16*** | (2006.01) |
| ***A47L 5/24*** | (2006.01) |

(52) U.S. Cl.

CPC ..... *A47L 5/04* (2013.01); *A47L 5/24* (2013.01); *A47L 7/0009* (2013.01); *A47L 7/0023* (2013.01); *B08B 5/04* (2013.01); *F04B 19/22* (2013.01); *F04B 23/02* (2013.01); *F04B 53/10* (2013.01); *F04B 53/109* (2013.01); *F04B 53/16* (2013.01)

(58) Field of Classification Search

CPC ..... A47L 5/04; A47L 5/20; A47L 5/24; A47L 7/0004–7/0042; A47L 7/0009; F04B 19/22; F04B 23/025; F04B 23/026; F04B 53/10; F04B 53/1002; F04B 53/1017

USPC ..... 15/397

See application file for complete search history.

(56) References Cited

U.S. PATENT DOCUMENTS 6,746,166 B1 * 6/2004 Jeon ..... A46B 11/0041 401/13

* cited by examiner

*Primary Examiner* — Bryan R Muller
(74) *Attorney, Agent, or Firm* — TraskBritt

(57) ABSTRACT

A pump for removing fluid from a floor covering includes a piston chamber, a piston disposed within the piston chamber, a nozzle plate for pressing against the floor covering and having a plurality of nozzles extending therefrom, a reservoir for storing fluid removed from the floor covering, and a diverting valve having an interior. The diverting valve defines a first fluid flow path, a second fluid flow path, and a third fluid flow path. A method of removing fluid from a floor covering includes causing a piston to move in a first direction within a piston chamber, drawing fluid through a plurality of nozzles of a nozzle plate and into the piston chamber, causing the piston to move in a second direction within the piston chamber, and pushing fluid from the piston chamber and into a reservoir extending circumferentially around the piston chamber.

17 Claims, 4 Drawing Sheets

PUMP FOR REMOVING FLUIDS FROM FLOOR COVERINGS AND RELATED METHODS

CROSS-REFERENCE TO RELATED APPLICATION(S)

This application claims priority to U.S. Provisional Patent Application No. 62/326,752 filed Apr. 23, 2016, the disclosure of which is incorporated in its entirety by reference herein.

TECHNICAL FIELD

Embodiments of the present disclosure relate generally to pumps for removing liquid from floor coverings. Embodiments of the present disclosure also relate to methods of removing liquid from floor coverings.

BACKGROUND

In the field of floor covering cleaning processes, there are two conventional methods for removing fluid from a floor covering (e.g., carpet). A first method includes placing an absorbent material on top of the floor covering and the fluid and applying pressure to the absorbent material to cause the absorbent material to absorb at least a portion of the fluid. However, placing an absorbent material on top of the floor covering and applying pressure pushes at least some of the fluid further into the floor covering. A second method is to use an electrical vacuum, which draws (e.g., sucks) the fluid out of the floor covering with the suction generated by electricity. This second method tends to leave a significant amount of fluid in the floor covering due to a need to keep the suction source filtered from the fluid in order to avoid electrocution. Filtering the suction source often reduces an available suction and reduces an effectiveness of the electrical vacuum.

DETAILED DESCRIPTION

The illustrations presented herein are not meant to be actual views of any particular device, but are merely idealized representations, which are employed to describe example embodiments of the present disclosure.

As used herein, any relational term, such as "first," "second," "over," "beneath," "top," "bottom," "underlying," "upward," "downward," etc., is used for clarity and convenience in understanding the disclosure and accompanying drawings, and does not connote or depend on any specific preference, orientation, or order, except where the context clearly indicates otherwise. For example, these terms may refer to an orientation of elements of the pump 100 relative to a floor surface upon which the pump 100 may be disposed and used to remove liquids (e.g., as illustrated in the figures).

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the terms "fluid" and "fluids" and their equivalents refer to substances that have no fixed shape and that yield relatively easily to external pressure. For example, fluids may include both liquids and gases.

Figure 1:
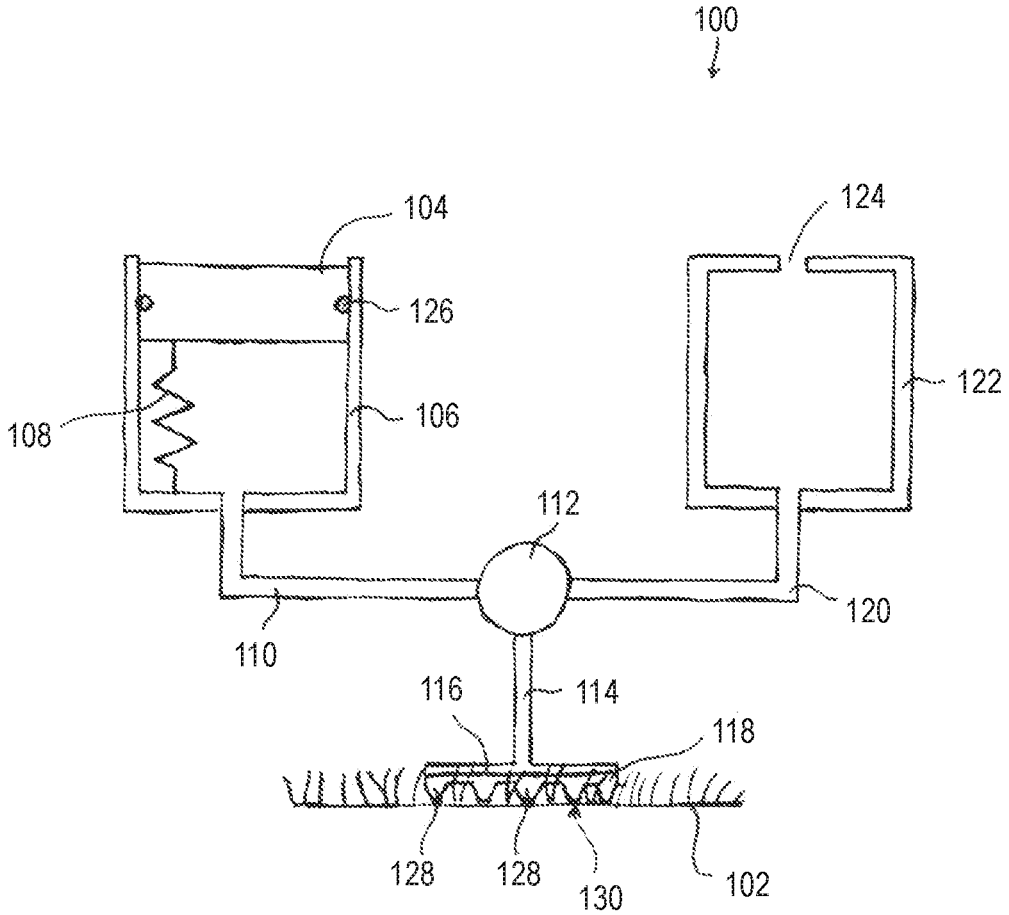
FIG. 1 is a schematic view of a pump for removing fluid from floor coverings according to an embodiment of the present disclosure.

FIG. 1 is a schematic view of a pump 100 for removing liquids from a floor covering 102 (e.g., carpet) according to an embodiment of the present disclosure. The pump 100 may include a piston 104, a piston chamber 106, at least one biasing member 108, a first fluid flow path 110, a diverting valve 112, a second fluid flow path 114, a nozzle guide 116, a nozzle plate 118, a third fluid flow path 120, a reservoir 122, and a vent 124. The piston 104 (e.g., a reciprocating member) may be disposed within the piston chamber 106 and may be configured to reciprocate back and forth within the piston chamber 106. The piston 104 may include a seal 126 disposed between the piston 104 and the piston chamber 106 (e.g., at an interface of the piston 104 and the piston chamber 106. The biasing member 108 may be disposed within the piston chamber 106. A first end of the at least one biasing member 108 may be attached to or at least abut up against a side of the piston 104 (e.g., a side of the piston 104 facing the piston chamber 106), and a second opposite end of the at least one biasing member 108 may be attached to an internal surface of the piston chamber 106. The at least one biasing member 108 may be configured to exert a force on the piston 104 and to move the piston 104 upward (as depicted in FIG. 1) and in a direction out of the piston chamber 106.

The first fluid flow path 110 may extend from the piston chamber 106 to the diverting valve 112 and may allow fluid to flow into the piston chamber 106 from the diverting valve 112 and fluid to flow into the diverting valve 112 from the piston chamber 106. In some embodiments, the diverting valve 112 may at least partially defined the first fluid flow path 110. The first fluid flow path 110 may be connected to the piston chamber 106 on a side of the piston chamber 106 containing the biasing member 108.

The second fluid flow path 114 may extend from the diverting valve 112 to the nozzle guide 116 and the nozzle plate 118. In some embodiments, the diverting valve 112 may at least partially define the second fluid flow path 114. The nozzle guide 116 may be disposed between the second fluid flow path 114 and the nozzle plate 118. The nozzle plate 118 may include a plurality of nozzles 128 on a first side thereof, and the nozzle guide 116 may be disposed on a second opposite side of the nozzle plate 118. Each nozzle of the plurality of nozzles 128 may include at least one opening 130 therein for drawing fluid into the nozzle 128. The nozzle guide 116 may guide fluid that is drawn (e.g., sucked) in through the plurality of nozzles 128 of the nozzle plate 118 during use of the pump 100 to the second fluid flow path 114 and the diverting valve 112. The second fluid flow path 114 may allow fluid that is drawn (e.g., sucked) in by the plurality of nozzles 128 of the nozzle plate 118 during use of the pump 100 to flow into the diverting valve 112.

The third fluid flow path 120 may extend from the diverting valve 112 to the reservoir 122 and may allow fluid to flow from the diverting valve 112 and into the reservoir 122. In some embodiments, the diverting valve 112 may at least partially define the third fluid flow path 120. The vent 124 may extend through a wall of the reservoir 122 and may provide fluid communication with an atmosphere.

In operation of the pump 100, the plurality of nozzles 128 of the nozzle plate 118 may be pressed against and/or at least partially into a floor covering 102 (e.g., carpet) having a liquid thereon and/or therein. A user may cause the piston 104 to move downward (as depicted in FIG. 1) within the piston chamber 106 and to compress the at least one biasing member 108. Causing the piston 104 to move downward within the piston chamber 106 and compressing the at least one biasing member 108 may be referred to herein as a "downward stroke." Although the phrase "downward stroke" is used herein to facilitate description of the pump 100 and for clarity, the phrase is not intended to connote a specific orientation of the pump 100 or piston 104. Rather, the phrase "downward stroke" is intended to refer to the piston 104 moving in a first direction within the piston chamber 106.

Causing the piston 104 to move downward within the piston chamber 106 may cause fluid that may be present within the piston chamber 106 to be pushed (e.g., expelled) out of the piston chamber 106 and through the first fluid flow path 110. Upon fluid being pushed through the first fluid flow path 110 and from the piston chamber 106 to the diverting valve 112, the diverting valve 112 may prevent fluid from flowing into the second fluid flow path 114 (e.g., may block a pathway to the second fluid flow path 114) and may cause the fluid to flow through the third fluid flow path 120 and into the reservoir 122. Preventing fluid flow from flowing into the second fluid flow path 114 from the diverting valve 112 may prevent the fluid from being expelled through the plurality of nozzles 128 of the nozzle plate 118.

After the piston 104 has been moved through the downward stroke, the piston 104 may be released by the user, and the at least one biasing member 108 may cause the piston 104 to move upward. Moving the piston 104 upward within the piston chamber 106 may be referred to herein as an "upward stroke." Although the phrase "upward stroke" is used herein to facilitate description of the pump 100 and for clarity, the phrase is not intended to connote a specific orientation of the pump 100 or piston 104. Rather, the phrase "upward stroke" is intended to refer to the piston 104 moving in a second direction opposite to the first direction within the piston chamber 106. Moving the piston 104 upward may cause fluid to be drawn (e.g., sucked) through the first fluid flow path 110 and into the piston chamber 106. Upon fluid being drawn through the first fluid flow path 110 and from the diverting valve 112 to the piston chamber 106, the diverting valve 112 may prevent fluid from being drawn through the third fluid flow path 120 and may allow fluid to be drawn through the second fluid flow path 114. In other words, the diverting valve 112 may block a pathway from the third fluid flow path 120 and open a pathway from the second fluid flow path 114. Drawing (e.g., sucking) fluid through the second fluid flow path 114 and into the diverting valve 112 and eventually into the piston chamber 106, may cause suction to be produced at the openings 130 of the plurality of nozzles 128 of the nozzle plate 118. Producing suction at the openings 130 of the plurality of nozzles 128 of the nozzle plate 118 may cause fluid present in the floor covering 102 (e.g., carpet) against which the nozzle plate 118 is pressed to be drawn through the openings 130 of the plurality of nozzles 128 and into the plurality of nozzles 128, through the nozzle guide 116, second fluid flow path 114, diverting valve 112, first fluid path, and into piston chamber 106.

After the piston 104 has been moved through the upward stroke, the piston 104 may again be caused by a user to move through the downward stroke as described above. Moving the piston 104 through the downward stroke may cause fluid that was drawn into the piston chamber 106 from the floor covering during the upward stroke to be pushed into the reservoir 122. Moving the piston 104 of the pump 100 through the above-described upward and downward strokes may be repeated to perform a reciprocating motion. This reciprocating motion may be continued as long as desired and/or needed to remove liquid from the flooring covering 102.

Figure 2A:
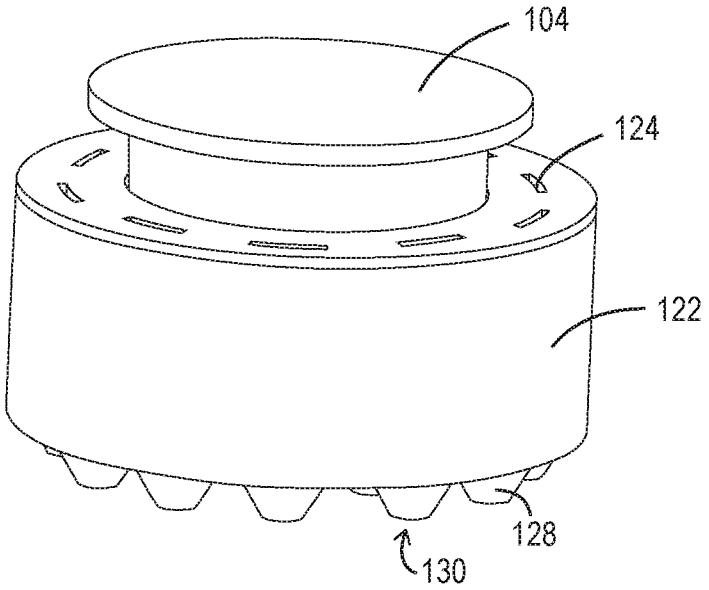
FIG. 2A is a perspective view of a pump for removing fluid from floor coverings according to an embodiment of the present disclosure.
Figure 2B:
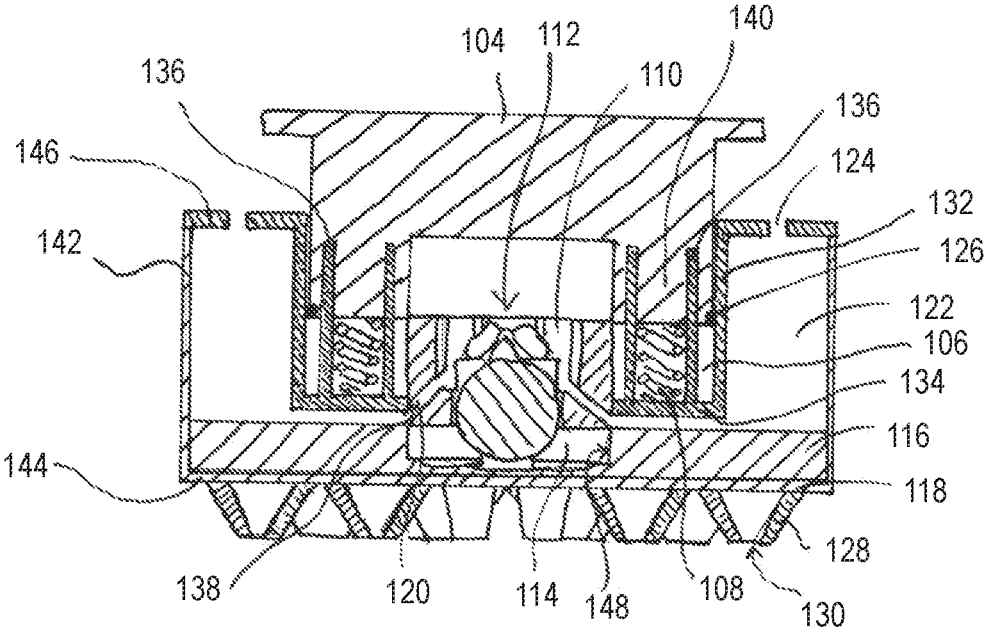
FIG. 2B is a side cross-sectional view of the pump of FIG. 2A.

FIG. 2A is a perspective view of an example implementation of the pump 100 of FIG. 1 according to an embodiment of the present disclosure. FIG. 2B is a cross-sectional view of the pump 100 shown in FIG. 2A. Referring to FIGS. 2A and 2B together, the pump 100 may be similar to the pump 100 described above in regard to FIG. 1. For example, the pump 100 may include a piston 104, a piston chamber 106, a plurality of biasing members 108, a first fluid flow path 110, a diverting valve 112, a second fluid flow path 114, a nozzle guide 116, a nozzle plate 118, a third fluid flow path 120, a reservoir 122, and at least one vent 124.

The piston 104 may be at least partially disposed within the piston chamber 106 and may be configured to reciprocate back and forth within the piston chamber 106. In some embodiments, the piston chamber 106 may include a cylindrical outer wall 132, a bottom wall 134, and a plurality of hollow columns 136. The bottom wall 134 may be at least generally circular in shape and may define a central hole 138 extending through the bottom wall 134. The cylindrical outer wall 132 of the piston chamber 106 may extend around a peripheral edge of the bottom wall 134 and may extend upward from the bottom wall 134, as depicted in FIG. 2B. For example, the cylindrical outer wall 132 and the bottom wall 134 of the piston chamber 106 may form a hollow cylindrical shape. The plurality of hollow columns 136 may be disposed between cylindrical outer wall 132 and the central hole 138 of the bottom wall 134 of the piston chamber 106. Furthermore, the plurality of hollow columns 136 may be attach to and may extend upward from the bottom wall 134 of the piston chamber 106. In some embodiments, the at least one biasing member 108 may be disposed within the plurality of hollow columns 136 of the piston chamber 106.

When the piston 104 is at least partially disposed within the piston chamber 106, the piston 104 may interface with an inner surface of the cylindrical outer wall 132 In some embodiments, the piston 104 may include a seal 126 that may be disposed between the piston 104 and the inner surface of the cylindrical outer wall 132 of the piston chamber 106. In some embodiments, the plurality of biasing members 108 may be disposed within the plurality of hollow columns 136. In other words, the plurality of hollow columns 136 may act as guides for the plurality of biasing members 108. The plurality of biasing members 108 may be configured to exert a force on the piston 104 and may cause the piston 104 to move through the upward stroke, as described above in regard to FIG. 1. In some embodiments, the piston 104 may include a plurality of solid columns 140 that are sized, shaped, and oriented to be insertable into the plurality of hollow columns 136 and to press against the plurality of biasing members 108 while the plurality of biasing members 108 are disposed within the plurality of hollow columns 136. Furthermore, the plurality of solid columns 140 may compress the plurality of biasing members 108 during a downward stroke, as described above in regard to FIG. 1. The solid columns 140 may allow the piston 104 to further compress the plurality biasing members 108 than would otherwise be achievable without the solid columns 140. Thus, the solid columns 140 may increase an effectiveness of the biasing members 108 in moving the piston 104 through the upward stroke. In some embodiments, the plurality of biasing members 108 may include a plurality of springs.

The reservoir 122 of the pump 100 may circumferentially surround the piston chamber 106. In other words, the reservoir 122 of the pump 100 may extend around a periphery of the piston chamber 106. The reservoir 122 may include an external wall 142, a bottom wall 144, and an upper wall 146. Furthermore, in some embodiments, the cylindrical outer wall 132 of the piston chamber 106 may form an inner wall of the reservoir 122. In some embodiments, the external wall 142 may be cylindrical in shape. In such embodiments, the cylindrical outer wall 132 of the piston chamber 106 and the external wall 142 of the reservoir 122 may be concentric to each other. The upper wall 146 of the reservoir 122 may be generally circular in shape and may extend between the external wall 142 of the reservoir 122 and the cylindrical outer wall 132 of the piston chamber 106. The plurality of vents 124 may extend through the upper wall 146 and may vent 124 an interior of the reservoir 122 to the atmosphere. In some embodiments, the bottom wall 144 of the reservoir 122 may form a portion of the nozzle plate 118. Furthermore, in some embodiments, the nozzle guide 116 may be disposed within the reservoir 122 and may be adjacent to the bottom wall 144 (i.e., nozzle plate 118) of the reservoir 122.

In some embodiments, the nozzle plate 118 and the nozzle guide 116 may be two separate pieces. In other embodiments, the nozzle plate 118 and the nozzle guide 116 may be a single uniform piece. Regardless, the nozzle guide 116 may have a central circular recess 148 extending at least partially through the nozzle guide 116 from a top surface of the nozzle guide 116. A diameter of the central circular recess 148 of the nozzle plate 118 and a diameter of the central hole 138 of the bottom wall 134 of piston chamber 106 may be at least substantially the same.

The diverting valve 112 may be at least partially disposed within the central circular recess 148 of the nozzle plate 118 and may extend up through the central hole 138 of the bottom wall 134 of the piston chamber 106. In other words, the diverting valve 112 may be seated within the central circular recess 148 of the nozzle plate 118 and may extend up from the nozzle plate 118 and into the piston chamber 106. As a result, at least a portion of the diverting valve 112 may be disposed within the piston chamber 106. In some embodiments, the diverting valve 112 may at least partially define the first fluid flow path 110, the second fluid flow path 114, and the third fluid flow path 120. The first fluid flow path 110, second fluid flow path 114, and third fluid flow path 120 are described in greater detail in regard to FIGS. 3A and 3B.

In some embodiments, the nozzle guide 116 may direct fluid that is drawn through the plurality of nozzles 128 of the nozzle plate 118 to the diverting valve 112 and second fluid flow path 114. The plurality of nozzles 128 may extend downward from nozzle plate 118 on a side of the nozzle plate 118 opposite the nozzle guide 116 and the diverting valve 112. In some embodiments, each nozzle 128 of the plurality of nozzles 128 may have a generally frustoconical shape. In other embodiments, the plurality of nozzles 128 may have generally cylindrical shapes. Each nozzle 128 of the plurality of nozzles 128 may be hollow (e.g., may have an aperture extending therethrough). Furthermore, each nozzle 128 of the plurality of nozzles 128 may have at least one opening 130 (e.g., hole for drawing (e.g., sucking) in fluid from the floor covering). In some embodiments, the opening 130 of each nozzle 128 of the plurality of nozzles 128 may be located at a tip of the nozzle 128. In some embodiments, each nozzle 128 of the plurality of nozzles 128 may include a plurality of openings 130. For example, the nozzle 128 may include an opening 130 at the tip of the nozzle 128 and additional openings 130 in a sidewall of the nozzle 128. In some embodiments, sizes of the openings 130 may vary depending on a location of the openings 130 in the nozzle 128. For example, an opening 130 located at a tip of the nozzle 128 may be larger (e.g., larger in diameter) than an opening 130 located in the sidewall of then nozzle 128.

In some embodiments, the plurality of nozzles 128 may vary in size. In other words, a first nozzle 128 of the plurality of nozzles 128 may have different size (e.g., longitudinal length, base diameter, tip diameter, etc.) than a second nozzle 128 of the plurality of nozzles 128. Furthermore, the sizes of the plurality of nozzles 128 may vary depending on the location of the plurality of nozzles 128 on the nozzle plate 118. For example, nozzles near a center of the nozzle plate 118 may be smaller in diameter than nozzle 128 near an outer periphery of the nozzle plate 118.

The plurality of nozzles 128 of the nozzle plate 118 may provide the pump 100 with a deeper access to fluids within a floor covering 102 when compared to conventional vacuums for removing fluid from floor coverings 102 (e.g., a shop vacuum). As a result, suction created at the tips of the plurality of nozzles 128 of the nozzle plate 118 of the pump 100 may be placed deeper within the floor covering 102 than suction provided by a conventional vacuum. Creating suction deeper within a floor covering 102 may result in more fluid being removed from the floor covering 102 than is removed by a conventional vacuum. Furthermore, the pump 100 of the present disclosure may provide suction at or near a backing of the floor covering 102 (e.g., backing of carpet). By providing suction at or near the backing of the floor covering 102, the pump 100 may remove fluid that may be against a layer beneath the floor covering 102 (e.g., carpet pad, flooring, etc.) Additionally, the pump 100 may provide advantages over conventional vacuums because the pump 100 does not require electricity. Therefore, there is no risk of electrocution from the pump 100. This may allow the pump 100 to be used in situations involving more fluid than is safe with conventional vacuums (e.g., a shop vacuums).

Figure 3A:
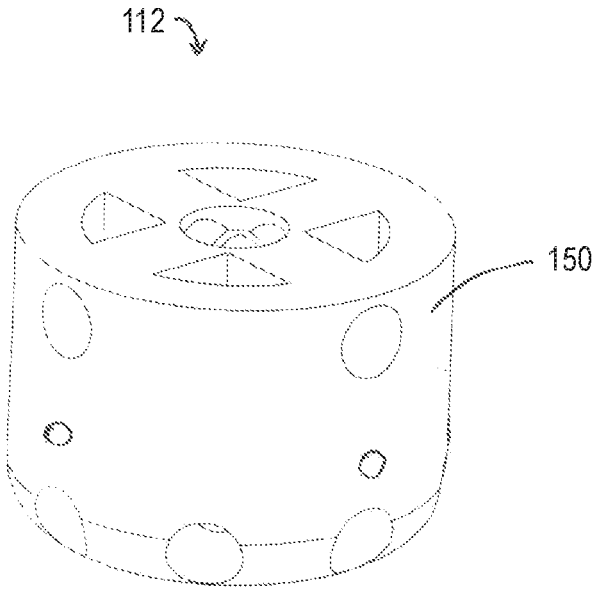
FIG. 3A is a perspective view of a diverting valve of the pump of FIG. 2A according to an embodiment of the present disclosure.
Figure 3B:
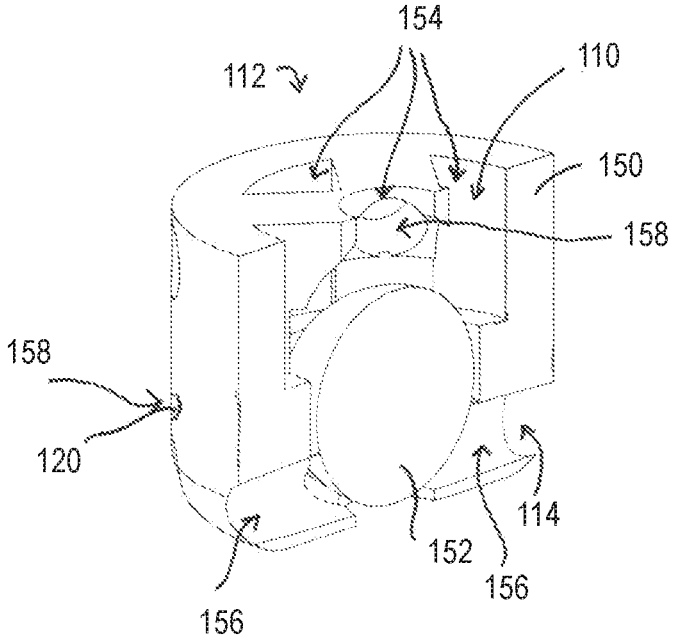
FIG. 3B is a perspective cross-sectional view of the diverting valve of FIG. 3A.

FIG. 3A is a perspective view of the diverting valve 112 of the pump 100 of FIGS. 2A and 2B. FIG. 3B is a perspective cross-sectional view of the diverting vale of FIG. 3A. Referring to FIGS. 2A-3B together, the diverting valve 112 may include a body portion 150 and a ball portion 152. The ball portion 152 may be disposed within an interior of the body portion 150. The body portion 150 may at least partially define the first fluid flow path 110, second fluid flow path 114, and third fluid flow path 120, and the ball portion 152 may be in fluid communication with each of the first fluid flow path 110, second fluid flow path 114, and third fluid flow path 120. In some embodiments, the first fluid flow path 110 may include a first plurality of apertures 154 extending downward into the body portion 150 of the diverting valve 112 from a top surface of the body portion 150 of the diverting valve 112. The second fluid flow path 114 may include a second plurality of apertures 156 extending radially into the body portion 150 of the diverting valve 112 from a side surface of the body portion 150 of the diverting valve 112. Furthermore, the second plurality of apertures 156 may be proximate a bottom of the diverting valve 112 such that when the diverting valve 112 is seated within the central circular recess 148 of the nozzle guide 116, the second plurality of apertures 156 are disposed within the central circular recess 148. The third fluid flow path 120 may include a third plurality of apertures 158 extending into the body portion 150 of the diverting valve 112 from the side surface of the body portion 150. Furthermore, the third plurality of apertures 158 may be proximate a center region of the side surface of the diverting valve 112.

The ball portion 152 may be configured to prevent flow through one or more of the first fluid flow path 110, second fluid flow path 114, and third fluid flow path 120 depending on a current operation of the pump 100.

In operation, during an upward stroke, as described above in regard to FIG. 1 (e.g., fluid is being drawn through the plurality of nozzles 128 and into the piston chamber 106), the ball portion 152 of the diverting valve 112 may be caused to move upward within the body portion 150 of the diverting valve 112 due to fluid flow and may be caused to block the third fluid flow path 120 to the reservoir 122 in order prevent fluid from being drawn into the diverting valve 112 from the reservoir 122. Furthermore, causing the ball portion 152 of the diverting valve 112 to be moved upward within the body portion 150 of the diverting valve 112 may unblock the second fluid flow path 114 and may allow fluid to be drawn from the plurality of nozzles 128 of the nozzle plate 118, through the nozzle guide 116, and into the diverting valve 112. Furthermore, when in an upper position (e.g., when caused to be moved upward), the ball portion 152 may not fully block the first fluid flow path 110 and may allow fluid to be drawn through the first fluid flow path 110 and into the piston chamber 106.

During a downward stroke, as described above in regard to FIG. 1 (e.g., fluid is being pushed from the piston chamber 106 into the reservoir 122), the ball portion 152 of the diverting valve 112 may be caused to move downward within the body portion 150 of the diverting valve 112 due to fluid flow and may be caused to block the second fluid flow path 114 to the nozzle guide 116 and the nozzle plate 118 in order prevent fluid from being pushed back out the plurality of nozzles 128. Furthermore, causing the ball portion 152 of the diverting valve 112 to be moved downward within the body portion 150 of the diverting valve 112 may unblock the third fluid flow path 120 and may allow fluid to be pushed from the piston chamber 106, through the diverting valve 112, and into the reservoir 122.

Figure 4A:
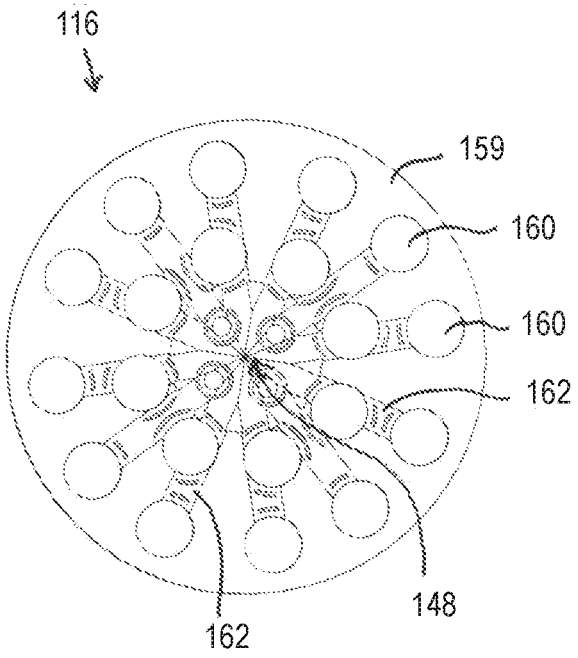
FIG. 4A is a top cross-sectional view of a nozzle guide of the pump of FIG. 2A according to an embodiment of the present disclosure.
Figure 4B:
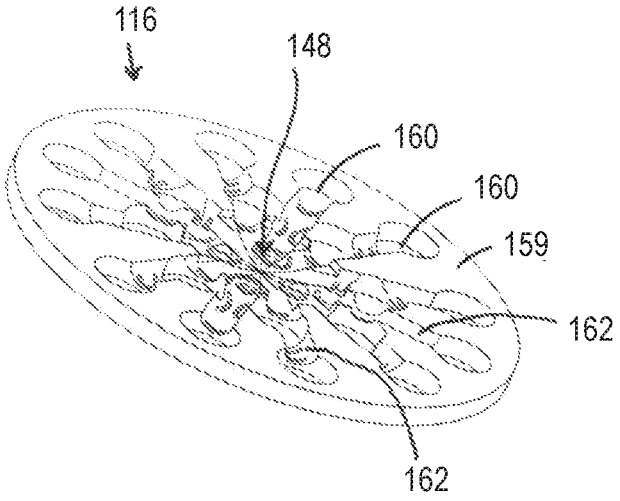
FIG. 4B is a perspective cross-sectional view of the nozzle guide of FIG. 4A.

FIG. 4A is a top cross-sectional view of the nozzle guide 116 according to an embodiment of the present disclosure. FIG. 4B is a perspective view of the nozzle guide 116 of FIG. 4B. Referring to FIGS. 2A, 2B, 4A, and 4B together, the nozzle guide 116 may include a plate 159, a plurality of holes 160 and a plurality of passages 162. The plurality of holes 160 may extend through the plate 159 of the nozzle guide 116 from a top surface thereof to a bottom surface thereof. The plurality of holes 160 may correlate to the plurality of nozzles 128 of the nozzle plate 118. In other words, each hole 160 of the plurality of holes 160 may correlate to a nozzle 128 of the plurality of nozzles 128. Furthermore, each hole 160 of the plurality of holes 160 may be located (e.g., formed in the nozzle 128) to align with a nozzle 128 of the plurality of nozzles 128 in the nozzle plate 118. The plurality of passages 162 may extend radially outward from a center of the plate 159 of the nozzle guide 116. Each hole 160 of the plurality of holes 160 may intersect with at least one of the plurality of passages 162. As a result, the plurality of passages 162 may provide a fluid flow path to the center of the plate 159 of the nozzle guide 116 from each hole 160 of the plurality of holes 160. In other words, the plurality of passages 162 may provide a fluid flow path to the central circular recess 148 of the nozzle guide 116 from each hole 160 or the plurality of holes 160.

When inserted into the central circular recess 148, the second plurality of apertures 156 in the diverting valve 112 defining the second fluid flow path 114 may be at least substantially aligned with at least some of the passages 162 of the plurality of passages 162. In other words, when the second plurality of apertures 156 defining the second fluid flow path 114 are aligned with in the plurality of passages 162, fluid flowing through the plurality of passages 162 may not be required to substantially change a flow direction to enter the second plurality of apertures 156. Aligning the second plurality of apertures 156 defining the second fluid flow path 114 with the plurality of passages 162 may provide for easier fluid flow from the plurality of nozzles 128 to the diverting valve 112. As a result, drawing fluid through the plurality of nozzles 128 and nozzle guide 116 may require less energy.

The pump 100 of FIGS. 2A-4B may operate in substantially the same manner as described above in regard to FIG. 1. Referring to FIGS. 2A-4B together, in operation of the pump 100, the plurality of nozzles 128 of the nozzle plate 118 may be pressed against and/or at least partially into a floor covering 102 (e.g., carpet) having a liquid thereon and/or therein. A user may cause the piston 104 to move downward (as depicted in FIG. 1) within the piston chamber 106 and to compress the plurality of biasing members 108 with the plurality of hollow columns 136 of the piston chamber 106 with the plurality of solid columns 140 of the piston 104.

Causing the piston 104 to move downward within the piston chamber 106 may cause fluid that may be present within the piston chamber 106 to be pushed (e.g., expelled) out of the piston chamber 106 and through the first fluid flow path 110 defined in the diverting valve 112. Upon fluid being pushed through the first fluid flow path 110 of the diverting valve 112, the ball portion 152 of the diverting valve 112 may be caused to move downward within the body portion 150 of the diverting valve 112 and to prevent fluid from flowing into the second fluid flow path 114. As a result, the fluid may be pushed through the third fluid flow path 120 in the diverting valve 112 and into the reservoir 122 of the pump 100. Preventing fluid from flowing into the second fluid flow path 114 may prevent the fluid from being expelled through the plurality of nozzles 128 of the nozzle plate 118.

After the piston 104 has been moved through the downward stroke, the piston 104 may be released by the user, and the plurality of biasing members 108 may cause the piston 104 to move upward. Moving the piston 104 upward may cause fluid to be drawn (e.g., sucked) through the first fluid flow path 110 in the diverting valve 112 and into the piston chamber 106. Upon fluid being drawn through the first fluid flow path 110 and into the piston chamber 106, the ball portion 152 of the diverting valve 112 be moved upward and may prevent fluid from being drawn through the third fluid flow path 120. Furthermore, moving the ball portion 152 upward may unblock the second fluid flow path 114 and may allow fluid to be drawn through the second fluid flow path 114 in the diverting valve 112. In other words, the diverting valve 112 may block a pathway from the third fluid flow path 120 and open a pathway from the second fluid flow path 114. Drawing (e.g., sucking) fluid through the second fluid flow path 114 and into the piston chamber 106, may cause suction to be produced at the openings 130 of the plurality of nozzles 128 of the nozzle plate 118. Producing suction at the openings 130 of the plurality of nozzles 128 of the nozzle plate 118 may cause fluid present in the floor covering (e.g., carpet) against which the nozzle plate 118 is pressed to be drawn through the openings 130 of the plurality of nozzles 128 and into the plurality of nozzles 128, through the nozzle guide 116, the second fluid flow path 114 in the diverting valve 112, the first fluid flow path 110, and into the piston chamber 106.

After the piston 104 has been moved through the upward stroke, the piston 104 can again be caused by a user to move through the downward stroke as described above. Moving the piston 104 through the downward stroke may cause fluid that was drawn into the piston chamber 106 from the floor covering 102 during the upward stroke to be pushed into the reservoir 122. Moving the piston 104 of the pump 100 through the above-described upward and downward strokes may be repeated to perform a reciprocating motion. This reciprocating motion may be continued as long as desired and/or needed to remove liquid from the flooring covering.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventor.

What is claimed is:

1. A pump for removing fluid from a floor covering, comprising:
- a piston chamber comprising:
- a bottom wall; and
- a plurality of hollow columns extending upward from the bottom wall
- a piston at least partially disposed within the piston chamber and configured to reciprocate within the piston chamber and wherein the piston comprises a plurality of solid columns sized, shaped, and oriented to be insertable into the plurality of hollow columns of the piston chamber;
- a nozzle plate for pressing against the floor covering and having a plurality of nozzles extending therefrom;
- a reservoir for storing fluid removed from the floor covering; and a diverting valve comprising an interior, the diverting valve at least partially defining:
  - a first fluid flow path extending from the piston chamber to the interior of the diverting valve;
  - a second fluid flow path extending form the nozzle plate to the interior of the diverting valve; and
  - a third fluid flow path extending from the reservoir to the interior of the diverting valve.

2. The pump of claim 1, wherein the diverting valve is configured to direct fluid flow through the first fluid flow path and the second fluid flow path when the piston is moving through the piston chamber in a first direction.

3. The pump of claim 2, wherein the diverting valve is configured to direct fluid flow through the third fluid flow path when the piston is moving through the piston chamber in a second direction opposite to the first direction.

4. The pump of claim 1, further comprising at least one biasing member disposed within the piston chamber and configured to exert a force on the piston and configured to cause to piston to move in a first direction.

5. The pump of claim 1, further comprising at least one vent extending through a wall of the reservoir.

6. The pump of claim 1, wherein the diverting valve comprises
- a body portion defining the interior; and
- a ball portion disposed within the interior of the body portion and configured to move upward and downward within the body portion of the diverting valve.

7. The pump of claim 1, further comprising a nozzle guide disposed between the diverting valve and the nozzle plate.

8. The pump of claim 7, wherein the nozzle guide comprises:
- a plate;
- a plurality of holes extending through the plate form a top surface thereof to a bottom surface thereof;
- a plurality of passages extending radially outward from a center of the plate, wherein each hole of the plurality of holes at least partially intersects with at least one passage of the plurality of passages; and
- a central circular recess extending at least partially through the plate from a top surface thereof.

9. A pump for removing fluid from a floor covering, comprising:
- a piston chamber;
- a piston at least partially disposed within the piston chamber;
- a reservoir for storing fluid removed from the floor covering, the reservoir extending circumferentially around the piston chamber and at least partially surrounding the piston chamber;
- a nozzle plate coupled to a bottom of the reservoir and having a plurality of nozzles extending therefrom;
- a nozzle guide disposed within the reservoir proximate the nozzle plate, the nozzle guide comprising:
- a plate having a plurality of holes extending through the plate from a top surface thereof to a bottom surface thereof;
- a plurality of passages extending radially outward from a center of the plate, wherein each hole of the plurality of holes at least partially intersects with at least one passage of the plurality of passages; and
- a central circular recess extending at least partially through the plate from a top surface thereof;
- a diverting valve seated within the central circular recess of the nozzle guide and extending at least partially into the piston chamber, the diverting valve having an interior, the diverting valve at least partially defining:
  - a first fluid flow path extending from the piston chamber to the interior of the diverting valve;
  - a second fluid flow path extending from the nozzle plate to the interior of the diverting valve; and
  - a third fluid flow path extending from the reservoir to the interior of the diverting valve.

10. The pump of claim 9, wherein the piston chamber comprises:

a bottom wall; and a plurality of hollow columns extending upward from the bottom wall, and wherein the piston comprises a plurality of solid columns sized, shaped, and oriented to be insertable into the plurality of hollow columns of the piston chamber.

11. The pump of claim 10, further comprising a plurality of biasing members disposed within the plurality of hollow columns of the piston chamber, wherein each biasing member of the plurality of biasing members is disposed within a respective hollow column of the plurality of hollow columns.

12. The pump of claim 9, wherein each nozzle of the plurality of nozzles of the nozzle plate may have a generally frustoconical shape.

13. The pump of claim 9, wherein the second fluid flow path at least partially defined by the diverting valve is at least substantially aligned with the plurality of passages of the nozzle guide.

14. The pump of claim 9, wherein each nozzle of the plurality of nozzles of the nozzle plate comprises a plurality of openings extending into the nozzle.

15. A method of removing fluid from a floor covering, comprising:

causing a piston that is at least partially disposed within a piston chamber to move in a first direction within the piston chamber, the piston chamber comprising:

a bottom wall; and a plurality of hollow columns extending upward from the bottom wall, and wherein the piston comprises a plurality of solid columns sized, shaped, and oriented to be insertable into the plurality of hollow columns of the piston chamber;

in response to moving the piston in a first direction, drawing fluid through a plurality of nozzles of a nozzle plate and into the piston chamber;

causing the piston to move in a second direction within the piston chamber; and in response to moving the piston in the second direction, pushing fluid from the piston chamber and into a reservoir extending circumferentially around the piston chamber and at least partially surrounding the piston chamber, the reservoir for storing fluid removed from the floor covering, and wherein the nozzle plate is coupled to a bottom of the reservoir.

16. The method of claim 15, wherein causing the piston to move in the second direction comprises allowing at least one biasing member to move the piston chamber.

17. The method of claim 16, wherein drawing fluid through the plurality of nozzles of the nozzle plate and into the piston chamber comprising drawing the fluid through the plurality of nozzles of the nozzle plate, through a diverting valve, and into the piston chamber.

* * * * *